United States Patent [19]

Conger

[11] 3,971,490

[45] July 27, 1976

[54] COLOR CATHODE RAY TUBE WITH IMPROVED FACEPLATE-FUNNEL REFERENCING STRUCTURES

[75] Inventor: Robert R. Conger, Chicago, Ill.

[73] Assignee: Zenith Radio Corporation, Chicago, Ill.

[22] Filed: Apr. 22, 1974

[21] Appl. No.: 462,915

[52] U.S. Cl. ..... 220/2.1 A; 313/406; 313/482

[51] Int. Cl.[2] ..... H01J 5/02; H01J 29/07

[58] Field of Search ..... 313/477, 482, 402, 404, 313/406, 477; 220/2.1 A, 2.3 A; 65/38, 42, 58, 138; 29/25.13, 25.15; 178/7.8, 7.82

[56] References Cited

UNITED STATES PATENTS

| | | | |
|---|---|---|---|
| 2,324,972 | 7/1943 | Wright | 65/36 X |
| 2,514,878 | 7/1950 | Kuperus | 220/2.1 A X |
| 2,755,405 | 7/1956 | Wilhelm | 220/2.1 A |
| 2,761,990 | 9/1956 | Amoursky et al. | 220/2.1 A X |
| 2,916,644 | 12/1959 | Kautz et al. | 313/402 |
| 2,942,129 | 6/1960 | May | 313/404 |
| 3,038,096 | 6/1962 | Knochel et al. | 220/2.1 A |
| 3,361,548 | 1/1968 | Hamilton et al. | 178/7.82 X |
| 3,369,881 | 2/1968 | Bennett et al. | 220/2.1 A X |
| 3,404,302 | 10/1968 | Nicklas | 220/2.1 A X |
| 3,497,746 | 2/1970 | Ouistermatt et al | 313/404 |
| 3,548,235 | 12/1970 | Driedijk et al. | 313/404 |
| 3,735,179 | 5/1973 | Kaplan | 313/402 |

FOREIGN PATENTS OR APPLICATIONS

| | | | |
|---|---|---|---|
| 534,178 | 2/1941 | United Kingdom | 65/58 |
| 692,228 | 6/1953 | United Kingdom | 65/36 |

*Primary Examiner*—George E. Lowland
*Assistant Examiner*—Stephen Marcus
*Attorney, Agent, or Firm*—John H. Coult

[57] ABSTRACT

This disclosure depicts a novel rectangular-type color cathode ray tube and a method of manufacturing such a tube which insures that a phosphor screen pattern deposited on the screen area of the tube faceplate is accurately referenced to the source of electron beams for the tube. The faceplate and the tube funnel have referencing means which define faceplate and funnel reference surfaces of such number and arrangement that the faceplate and the funnel are interlocked to prevent beyond-tolerance relative movement therebetween. In a preferred structure disclosed, the faceplate has internal referencing means in three corners. The funnel has in each of three corresponding corners a pair of spaced, inside funnel reference surfaces oriented to capture the associated faceplate referencing means.

6 Claims, 20 Drawing Figures

10
11
12
13
14
15
16a
16b
17a
17b
18a
18b
19
20
21
22
23
24
25
26
28
30
32
35

80
76
72
14
82
102
84
74
12
78
100

12
11
13
15
98
87
74
90
86
88
92
96

COLOR CATHODE RAY TUBE WITH IMPROVED FACEPLATE-FUNNEL REFERENCING STRUCTURES

CROSS-REFERENCE TO RELATED APPLICATIONS

This application relates to, but is not dependent upon, copending applications Ser. No. 395,334, filed Sept. 7, 1973 (now Pat. No. 3,912,963); Ser. No. 428,176, filed Dec. 26, 1973 (now Pat. No. 3,912,906); Ser. No. 424,017, filed Dec. 12, 1973 (now Pat. No. 396,321); Ser. No. 446,845, filed Feb. 28, 1974 (now patent No. 3,904,914); Ser. No. 527,001 filed Nov. 25, 1974; Ser. No. 535,473, filed Dec. 23, 1974 (now issued as patent No. 3,943,399 a continuation-in-part of now abandoned applicaton Ser. No. 395,106, filed Sept. 7, 1973). Ser. No. 573,692, filed May 1, 1975, (a division of applicaton Ser. No. 446,845); and Ser. No. 528,533, filed Nov. 29, 1974 all having a common assignee herewith.

This invention relates to a novel color cathode ray tube of a rectangular type having a flangeless faceplate and a color selection electrode, and an improved method for making such a tube which insures that a phosphor screen pattern depositioned on the faceplate inner surface is accurately referenced to the source of electron beams for the tube. "Phosphor screen pattern" is herein intended to mean a pattern of interleaved arrays of red-emissive, blue-emissive and green-emissive cathodo-luminescent elements and, in tubes of the negative guardband type, the associated "black grille."

Conventional color cathode ray tubes have a glass envelope which comprises a flanged front panel sealed to a funnel. The front panel flange has embedded in its inner surface a number of studs which serve to support a color selection electrode adjacent to a phosphor screen pattern deposited on the inner surface of a faceplate portion of the front panel. A neck for housing electron guns for the tube is sealed to the funnel.

Proper tube operation requires that the phosphor screen pattern and the aperture pattern in the associated color selection electrode be aligned with respect to the effective source of electron beams in the assembled tube in the same way that they were aligned with respect to the effective point light source used to screen the phosphor pattern on the faceplate. If this corresponding relative alignment is not established, color purity errors will inevitably be exhibited in the images displayed by the end product tube.

In conventional tubes, the necessary referencing of the phosphor screen pattern and the effective source of electron beams in established by the following method. The conventional referencing method will be best understood if the reader keeps in mind the general principle that two things referenced to a third thing are referenced to each other.

It is conventional during the photoscreening operations in which the phosphor patterns (and the black grille in negative guardband tubes) are deposited, to reference the front panel to three external reference points, typically three rigid posts against which the front panel is urged during the photoscreening operations. Thus, the screen pattern is deposited on the faceplate with reference to three fixed, known reference points. This referencing principle is portrayed in FIG. 1 wherein R represents the fixed external reference (the three reference posts), and reference line RLa represents the referencing of the screen pattern 2 on faceplate portion 3 of a front panel 4 to the reference R.

During sealing of the neck 5 to the funnel 6 (depicted diagrammatically in FIG. 2) the effective source 7 of electron beams generated by the electron guns (shown schematically as 8), i.e., the apparent "center of deflection" of the beams, is referenced to three corresponding external reference points. More particularly, in conventional practice the neck 5 is first sealed to the funnel 6 in a glass-to-glass sealing operation. The center line C/L of the neck 5 (on which the effective source 7 of electron beams will utimately lie) is then referenced to the said three corresponding external reference points by grinding reference surfaces 9 (commonly termed "pads") on the outside surface of the funnel to the required high degree of accuracy (typically about ± 12 mils tolerance). The neck center line 8 and effective source 7 of electron beams are thus referenced to reference R, as represented by reference line RLb.

To assemble a conventional tube according to conventional practice, a sealing fixture is employed which has in an upper plane three carbon buttons defining three reference points which correspond in location to the afore-described three reference points used in photoscreening the front panel. These panel referencing buttons engage and position the front panel during the funnel-panel sealing operation. In a lower plane, a similar set of three funnel referencing buttons are provided which are aligned with respect to the panel referencing buttons and which are positioned to engage the three external reference surfaces 9 ground on the funnel 6. Such a fixture is described in U.S. Pat. No. 3,737,065.

To seal a conventional funnel and front panel, a frit-type solder glass is deposited on the funnel seal land and the funnel is placed in a fixture, such as described, with the funnel bearing against the three panel referencing buttons. The front panel is placed on the funnel against the three panel referencing buttons. Since the panel referencing buttons and the funnel referencing buttons are aligned with respect to each other and can be considered as a single reference, it can be understood that the screen pattern on the front panel is thus referenced to the center line of the tube neck and thereby to the effective source of electron beans when the electron gun is ultimately assembled in the tube neck.

The referencing principles which apply to the described panel-funnel sealing operation are shown diagrammatically in FIG. 3. It can be seen that since the screen pattern 2 and neck center line are both referenced to the same external reference R, they are therefore referenced to each other.

The described conventional method for assembling conventional color tube envelopes accomplishes referencing of the phosphor screen pattern to the effective source of electron beams and is statisfactory from a performance and yield standpoint when the sealing fixtures are in good working condition yet, the conventional method has a number of drawbacks. Note in FIG. 3 that the external reference R (the six reference buttons on the conventional sealing fixture) must be preserved during the panel-funnel sealing operation. These sealing fixtures are subjected to extreme temperature cycling as they are heated and cooled during the frit-sealing operation. The temperature cycling of these fixtures inevitably results in accuracy degradation with resultant high maintenance cost and decrease in yield of the sealing operation due to referencing accuracy losses. Also, the described conventional referencing method requires that high accuracy reference surfaces be ground on the funnel, an operation which adds to the cost of the end product tube.

The referent U.S. Pat. No. 3,904,914 is directed to providing an improved color cathode ray tube of the type having a color selection electrode, in particular to providing such a tube which includes a low-cost system for supporting the color selection electrode and for referencing the tube faceplate and funnel. The referent copending application Ser. No. 573,692 is directed to an improved method of fabricating such a novel color cathode ray tube which insures that the phosphor screen pattern is accurately referenced to the source of electron beams for the tube.

OBJECTS OF THE INVENTION

It is an object of this invention to provide in a color tube of the novel type described in the referent copending patents and applications, improved referencing structures for referencing the faceplate and funnel, and in preferred embodiments faceplate referencing structures which serve also to suspend the color selection electrode adjacent the tube faceplate.

It is another object to provide apparatus for referencing the faceplate and funnel of a color cathode ray tube by which the faceplate and the funnel are interlocked against beyondtolerance translational and rotational movement therebetween, thereby permitting the frit sealing of the faceplate to the funnel with the tube in an upright attitude.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

FIGS. 5–9 depict a novel color cathode ray tube embodying certain principles of this invention. In conventional shadow mask-type color tubes, the color selection electrode is supported by studs embedded in the inner surface of a flange provided on the tube faceplate or "front panel." These studs do not play a direct part in the referencing of the phosphor screen pattern and the effective source of electron beams. Rather, referencing is accomplished using an external reference, as described above.

Figure 4:
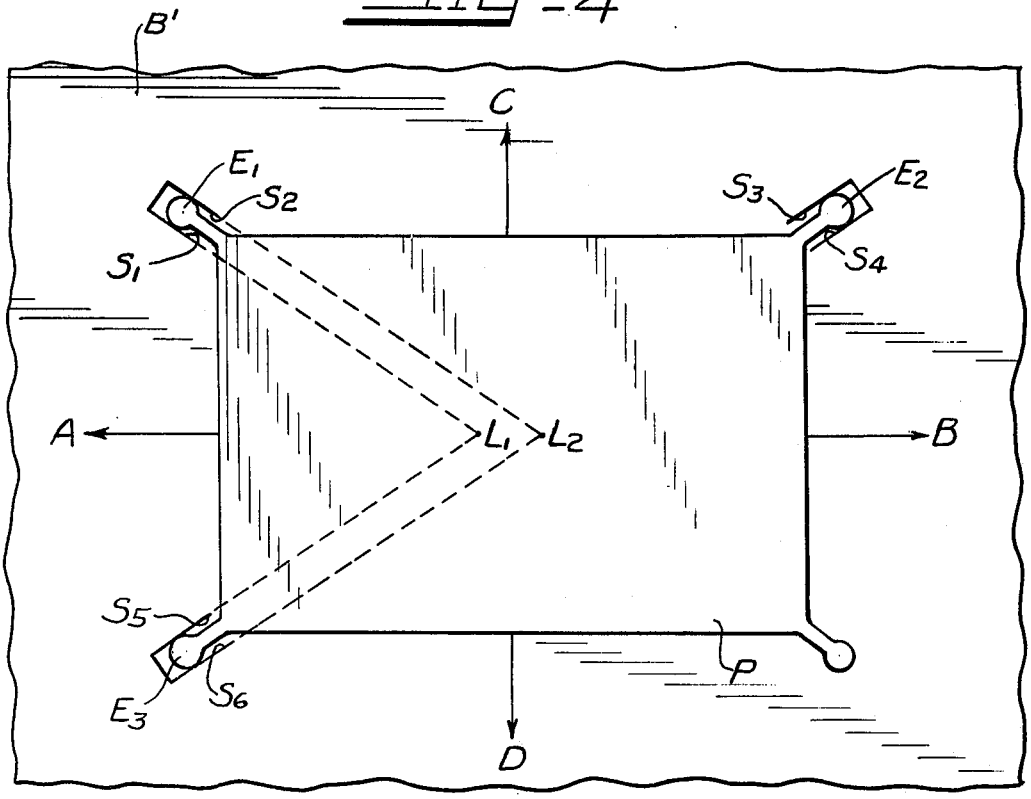
FIG. 4 is a diagram illustrating certain referencing principles underlying the invention.

Before engaging a detailed discussion of preferred implementations of the invention, a discussion of certain principles which underlie the invention will be discussed. FIG. 4 is a diagram which illustrates the referencing of a plate P to a base structure B′ by the use of referencing means on the plate P and base B′. The plate P is provided with referencing means in the form of three extensions, $E_1$, $E_2$ and $E_3$ which are embraced by and captured between three separated, mutually non-parallel pairs of spaced reference surfaces on the base B′, labeled in FIG. 4 as $S_1$, $S_2$, $S_3$, $S_4$, $S_5$ and $S_6$.

It can be seen that translation of the plate P in the direction shown by vector A (to the left in FIG. 4) is prevented by engagement of the extensions $E_1$ and $E_3$ with the surfaces $S_1$ and $S_5$. The dotted line extensions of surfaces $S_1$ and $S_5$ converge at a line $L_1$, showing that these surfaces define a wedge-shaped confining boundary for the plate P. Similarly, the confining surfaces $S_2$ and $S_6$ also converge at a line $L_2$ and act to define a confining boundary preventing translational movement of the plate P in a direction represented by the vector B (to the right in FIG. 4). Translational movement of the plate in the direction of vector C (upward in FIG. 4) is prevented by one or both of the surfaces $S_2$ and $S_5$; translational movement in the direction D is precluded by the presence of surfaces $S_1$ and $S_6$. Thus, the two pairs of spaced reference surfaces $S_1$-$S_2$ and $S_5$-$S_6$ effectively capture the plate P against any translational movement beyond that permitted by the tolerances assigned to the location and dimensions of the extensions $E_1$ and $E_3$ and of the reference surfaces $S_1$-$S_2$ and $S_5$-$S_6$.

In order to also capture the plate P against rotational movement, third and forth reference surfaces are required. The third and fourth reference surfaces are shown as taking the form of a third pair of spaced reference surfaces $S_3$-$S_4$. The reference surfaces $S_3$-$S_4$ capture the extension $E_2$ of the plate P and prevent beyond-tolerance rotational movement of the plate P in either direction. It should be understood that the above analysis could be applied from the view that the reference surfaces $S_1$-$S_2$ and $S_3$-$S_4$ prevent beyond-tolerance translational movement of the plate P, with the third pair of reference surfaces $S_5$-$S_6$ acting to prevent beyond-tolerance rotational movement of the plate P.

Viewed another way — the combination of surfaces $S_3$-$S_4$ and $S_5$-$S_6$ permit no beyond-tolerance movement of plate P along the other diagonal, i.e., parallel to surfaces $S_1$ and $S_2$. Surfaces $S_1$-$S_2$ permit no beyond-tolerance movement of the plate P along the first diagonal. Together, the pairs of surfaces $S_1$-$S_2$, $S_3$-$S_4$ and $S_5$-$S_6$ preclude beyond-tolerance translational and rotational movement of the plate P relative to the base B'.

It should be understood that the principles of this invention are applicable also to the provision of referencing systems wherein structures corresponding to the plate P and base B' have referencing means which prevent beyond-tolerance relative translational movement therebetween, but in which a single reference surface is used to fix the rotation or angular attitude of the plate P relative to the base B'. In the above-described FIG. 4 system, $S_4$ might be eliminated and the plate P held against $S_3$ by gravitational or other forces to assure the predetermined angular relationship of the plate P and base B'. However, to provide a fully captured system, that is, one in which the plate P is captured against beyond-tolerance translational and rotational movements, as described, it is necessary that six reference surfaces be provided.

It should also be understood that whereas in the described example the plate P has extensions which are received between reference surfaces provided on the base, the reverse could be true — that is, the extensions or other functionally corresponding reference structures, could be provided on the base B' and the capturing reference surfaces provided on the plate P. Further, whereas the pairs of spaced reference surfaces are shown in FIG. 4 as being located on the corners of a rectangle, they could just as well be located at other spaced positions around the perimeter of the rectangle. A fourth set of one or more reference surfaces could also be provided, however such a set would be redundant with the three described and is therefore unnecessary.

The relationship and application of the principles described and illustrated in FIG. 4 to the faceplate and funnel structures of a color cathode ray tube will become readily apparent from the following description.

This invention is most advantageously implemented in rectangular color tubes of a novel type having a flangeless faceplate which is sealed directly to the mouth of the funnel. FIGS. 5–9 illustrate a color tube representing one of the many possible implementations of the invention. The FIGS. 5–9 tube is illustrated as comprising a flangeless, spherically contoured faceplate 10 which mates with and is sealed to a funnel 12. A neck 14 is sealed to the funnel 12.

In accordance with an aspect of the illustrated preferred execution of this invention, the funnel 12 is provided with a pair of spaced inside reference surfaces in three corners of the mouth region of the funnel 12. The pairs of funnel reference surfaces are shown as comprising three pairs of reference surfaces **16*a*, 16*b*, 17*a*, 17*b*, 18*a* and 18*b* in three corners of the funnel. The pairs of reference surfaces are formed as opposing side surfaces on notches 11, 13 and 15 which are formed in bosses 19, 20 and 21 molded integrally in the funnel 12. As used herein, the "funnel reference surfaces" may be surface areas molded integrally into the funnel, as shown at 16*a*-18*b* in the FIGS. 5–9** embodiment, or they may be provided by auxiliary structures mounted within the funnel.

The notches 11, 13 and 15 are illustrated as each having an open side which addresses the tube axis. The notch sides adjoining the open side constitute the pairs of funnel reference surfaces. The notches 11, 13 and 15 may have various cross-sectional configurations and dimensions consistent with the teachings of this invention; in the illustrated embodiment they preferably have a generally rectangular cross-section for reasons which will become evident below. The notches are preferably each oriented toward the faceplate center.

The faceplate 10 includes in corresponding corners, referencing means defining at least one faceplate reference surface for mating with the afore-described funnel reference surfaces **16*a*, 16*b*, 17*a*, 17*b*, 18*a* and 18*b*. As will be described in detail hereinafter, in the preferred embodiments of this invention, such as the FIGS. 5–9 embodiment, the referencing means are projections in the form of studs 22, 23, 24 and 25 which each define a pair of faceplate reference surfaces. As described in detail below, the studs serve also to support a color selection electrode 26 adjacent the inner surface of the faceplate 10 which receives a phosphor screen pattern 28**.

Figures 5, 6, 7:
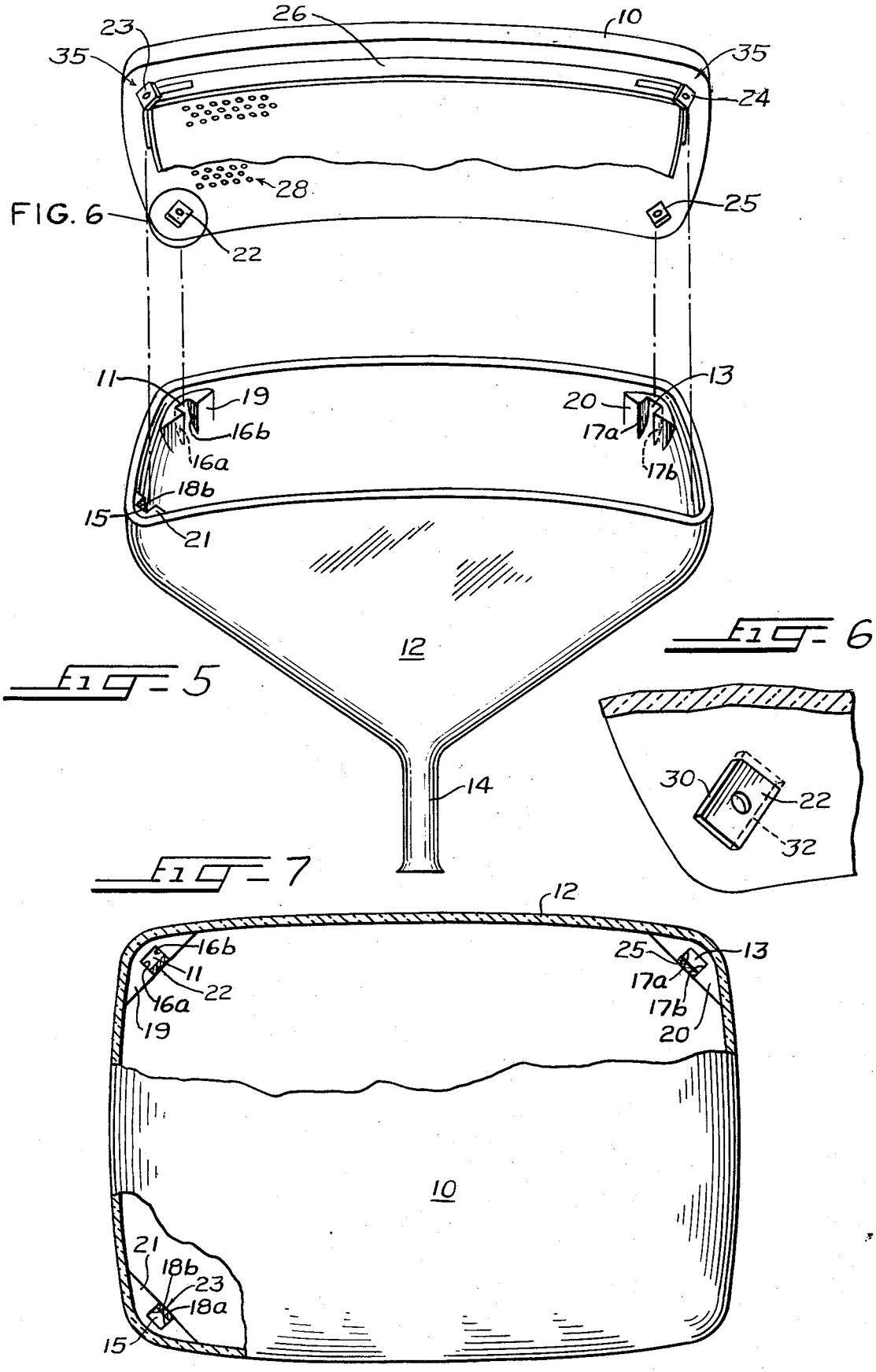
FIG. 5 is an exploded, schematic, partially fragmented view of components of a color cathode ray tube constructed according to this invention, certain parts having exaggerated or distorted dimensions in order to more clearly illustrate the invention.
FIG. 6 is an enlarged view of a component of the FIG. 5 tube.
FIG. 7 is a plan view of the FIG. 5 tube, assembled and partly broken away to illustrate an aspect of the invention.
Figure 8:
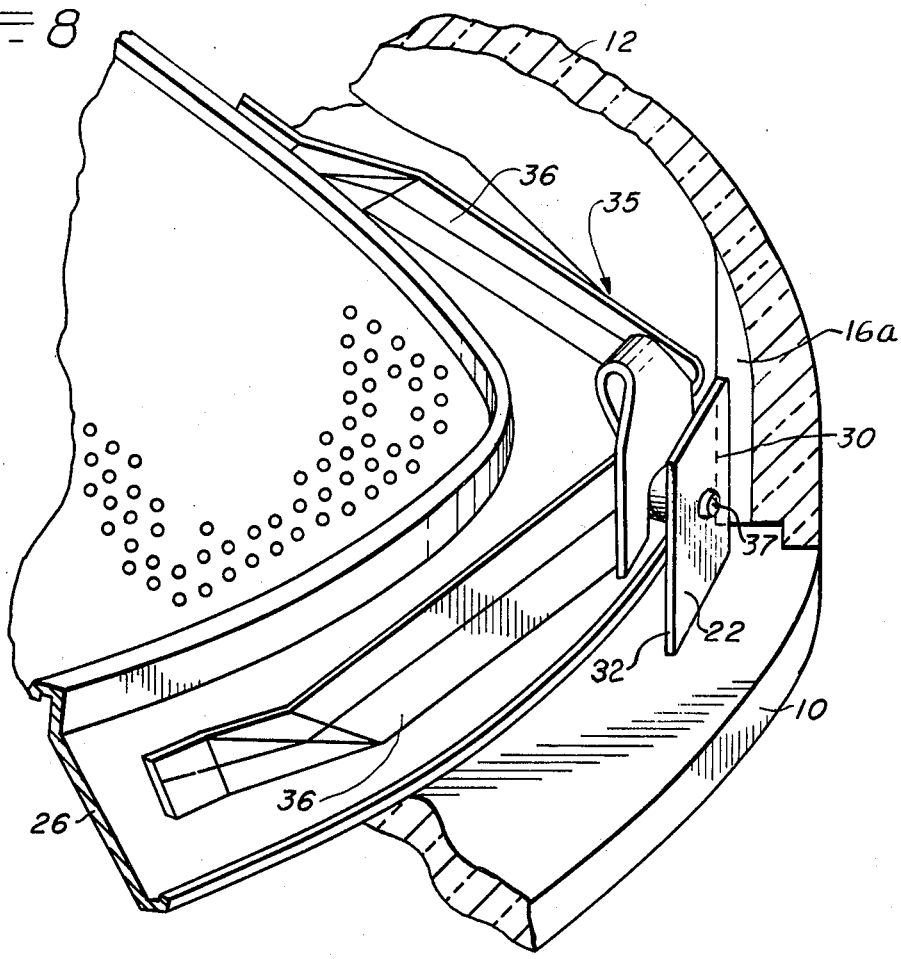
FIGS. 8 and 9 are enlarged perspective views with parts broken away, of a corner of the assembled FIGS. 5 and 7 tube, showing in particular a suspension system for suspending the color selection electrode in the tube.
Figure 9:
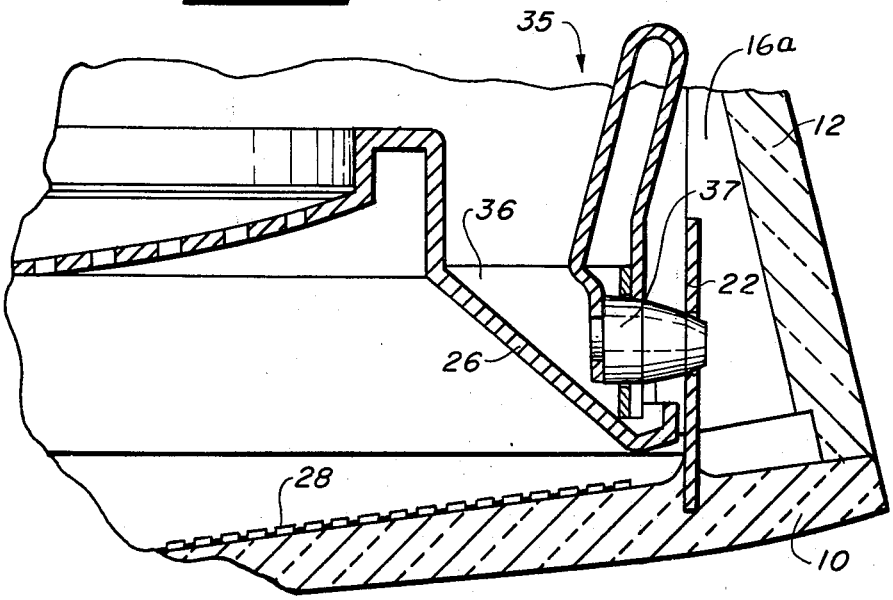

Stud 22 is shown enlarged in FIG. 6. It may take a variety of forms, but preferably comprises a sheet metal stamping of generally rectangular cross-section which is embedded in the faceplate or cemented thereon.

As shown clearly in FIG. 7, when the faceplate 10 is sealed to the funnel 12, the studs 22, 23 and 25 fit closely into notches 11, 13 and 15 and the two edges of each stud, constituting a pair of faceplate referencing surfaces, engage and are closely embraced by the funnel reference surfaces. For example, reference surfaces 30, 32 of stud 22 are embraced by funnel reference surfaces **16*a* and 16*b*. Similarly, the side edges of stud 25 constitute faceplate reference surfaces which engage funnel reference surfaces 17*a* and 17*b*. Likewise, the side edges of stud 23 engage funnel reference surfaces 18*a* and 18*b***. The spacing of the funnel reference surfaces in each pair is slightly greater than the width of the studs such that the funnel reference surfaces closely confine the studs. By way of example, the studs may each have a width of about 0.500 inch with a tolerance of plus 0.000, minus 0.005 inch and the notches may have a width of about .510 inch with a tolerance of plus 0.020, minus 0.000 inch. The notches may have a maximum radial depth of approximately 0.393 inch and a maximum axial depth (top to bottom) of about 0.750 inch. The studs may have a length of about 0.625 inch and thickness of about 0.040 inch.

The novel studs 22–25 do not, per se, constitute a part of this invention, but are described and claimed in the referent U.S. Pat. No. 3,890,526.

As stated, in accordance with a preferred implementation of the principles of this invention, the faceplate referencing means (studs 22-25 in FIGS. 5–9) have plural functions. Consider particularly FIGS. 5, 8 and 9 which show the studs 22-25 as constituting part of suspension devices 35 for supporting the color selection electrode 26. Neither the color selection electrode 26 nor the suspension devices 35, per se, constitute a part of this invention. The electrode 26 is described and claimed in the referent U.S. Pat. No. 3,912,963 the suspension devices 35 are described and claimed in the referent copending application Ser. No. 498,836, U.S. Pat. Nos. 3,896,321 and 3,943,399.

Briefly, the color selection electrode 26 is a one-piece, frameless mask having integral means for stiffening the electrode and for shielding the screen from overscanned and stray electrons. The suspension devices 35 are located at the corners of the electrode 26 and each comprise brackets 36 supporting a spring-biased lug 37 which retentively engages an aperture in the mating stud. Other structural details and features of the electrode 26 and suspension device 35 are described in the referent patents and copending applications.

It is an aspect of the invention described in the referent U.S. Pat. No. 3,904,914 and application Ser. No. 573,692 to provide, in the fabrication of a color cathode ray tube, an improved method for referencing a screen pattern on the tube faceplate to an effective source of electron beams for the tube. This method will be described in order to further an understanding of the present invention. The method comprises, in broad terms, causing the funnel to be provided with three or more spaced, inside funnel reference surfaces. The faceplate is provided with inside referencing means defining a number of faceplate reference surfaces correspondingly spaced and located to engage the funnel reference surfaces when the faceplate and funnel are assembled. A pattern of cathodo-luminescent phosphor elements is deposited on an inner surface of the faceplate with reference to the faceplate reference surfaces. A neck is attached to the funnel with the neck center line referenced to the funnel reference surfaces. Finally, the faceplate is sealed to the funnel, the sealing operatism including bringing the faceplate reference surfaces and the funnel reference surfaces into referencing engagement during the sealing operation. The screen pattern on the faceplate is thereby referenced to the neck center line and thus to the effective source of electron beams projected by electron gun means ultimately mounted on the center line of the neck.

Figure 10:
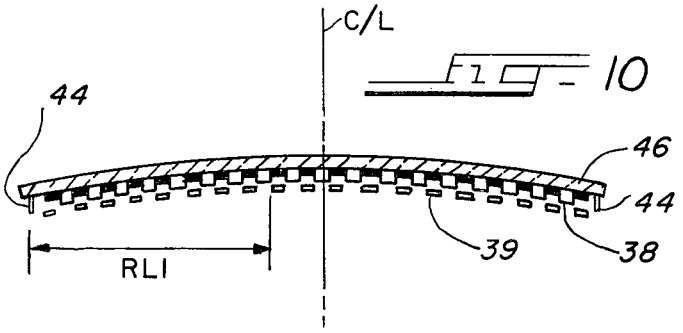
FIGS. 10–12 diagrammatically depict a method for referencing the screen pattern on the faceplate of a color cathode ray tube to the effective source of electron beams in the assembled tube.
Figure 11:
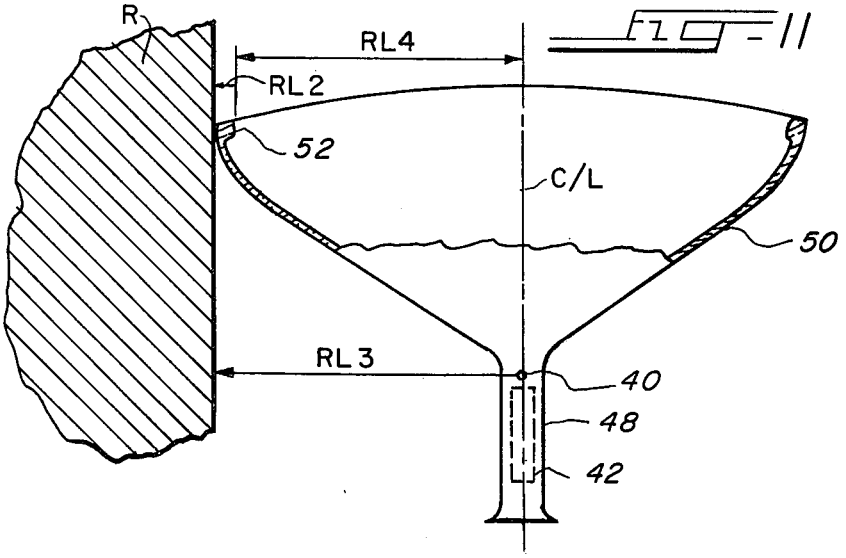
Figure 12:
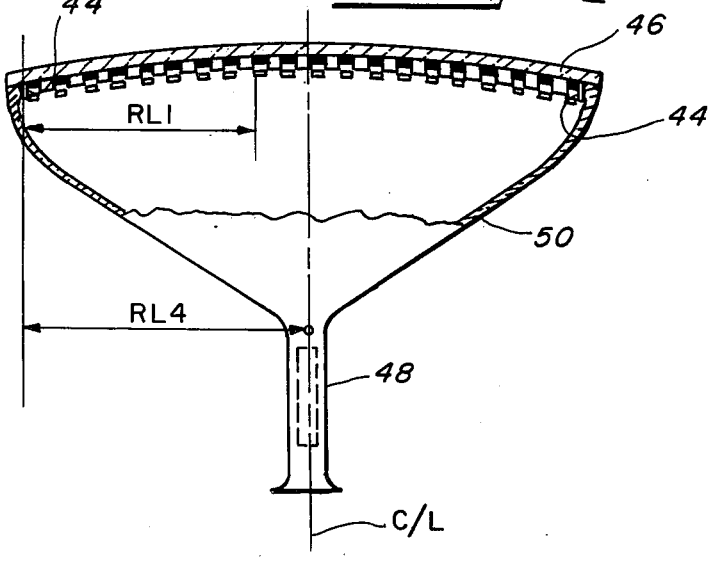

These referencing principles are revealed in FIGS. 10–12. FIGS. 10–12 illustrate diagrammatically the way in which a screen pattern 38 and an associated color selection electrode 39, are referenced to an effective source 40 of electron beams projected by electron gun means, shown schematically as 42. The referencing principles represented by each of FIGS. 10, 11 and 12 will be described in detail hereinafter.

FIG. 10 is intended to portray diagrammatically that the phosphor pattern 38 and the faceplate referencing means, preferably an electrode-supporting stud 44 embedded in faceplate 46, as described, are referenced to each other, as represented by reference line RL1.

In the sealing of a neck 48 to a funnel 50, the center line C/L of the neck (on which will lie the effective source 40 of electron beams), and the funnel reference surfaces 52 are both referenced to a common external reference R. The effective electron source 40 and the reference surface 52 are thus referenced to each other. See FIG. 11; the referencing of the reference surface 52 to the external reference R is represented by reference line RL2 and the effective source 40 to reference R by line RL3. The mutual referencing of reference surface 52 and effective source 40 is represented by reference line RL4.

During assembly of the tube, the stud 44 is brought into referencing enegagement with the reference surface 52 to reference the faceplate 46 to the funnel 50. The screen pattern 38 and associated color selection electrode 39 are thus referenced to the center line of the neck 48 and thereby to the effective electron source 40.

Figure 1:
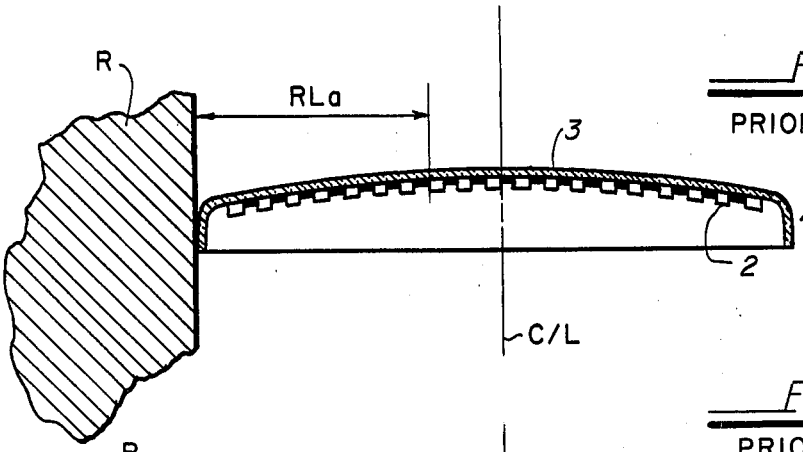
FIG-1 PRIOR ART
FIGS. 1–3 diagrammatically depict a conventional method for referencing the screen pattern on the front panel of a color cathode ray tube to the effective source of electron beams in the assembled tube.
Figure 2:
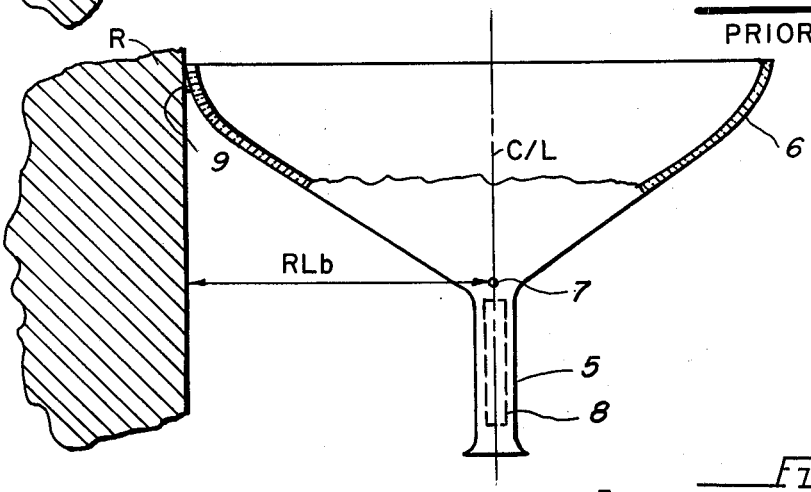
FIG-2 PRIOR ART
Figure 3:
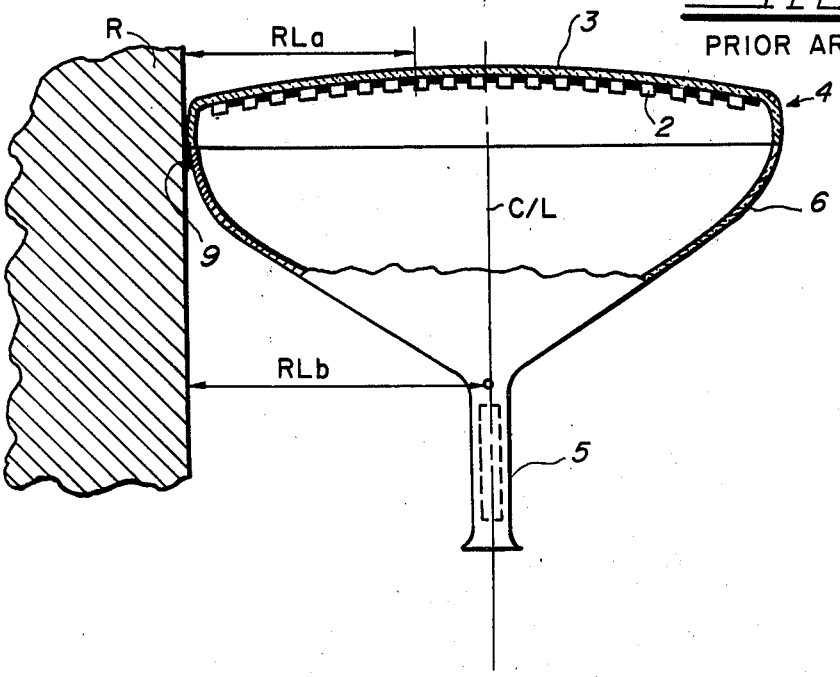
FIG-3 PRIOR ART

It is informative at this point to compare the FIGS. 10–12 diagrams with the corresponding FIGS. 1–3 diagrams which depict the conventional referencing principles. Note that whereas in the conventional method (FIGS. 1–3) it is necessary to carry the external reference R through the panel-funnel sealing operation (FIG. 3), referencing is accomplished within the tube in the described novel method (FIG. 12). No external reference need be provided which must be carried through the sealing operation. As noted above, the result is substantial savings in fixtureassociated expenses, and improved referencing accuracy.

Figure 13:
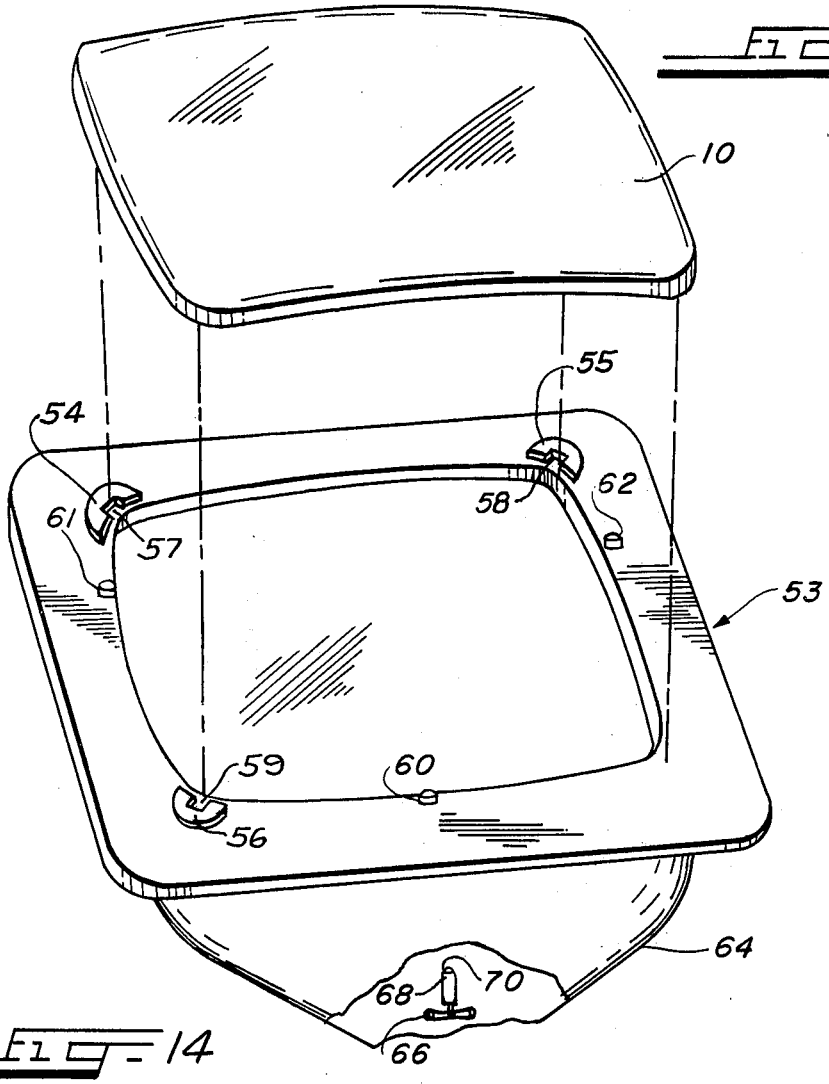
FIG. 13 is a schematic, partially exploded view of an exposure table for exposing a faceplate according to the said referencing method.
Figure 14:
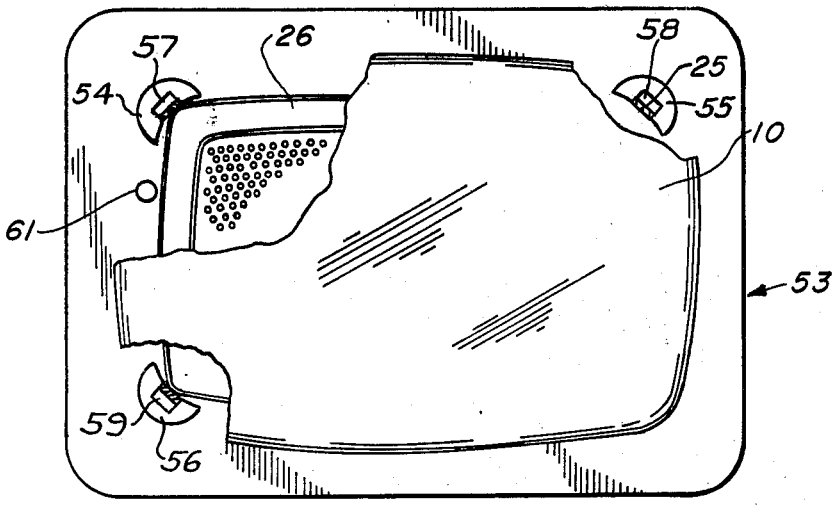
FIG. 14 is a view of the FIG. 13 exposure table with the faceplate and attached color selection electrode in place, a portion of the faceplate being broken away to reveal hidden internal components.

The referencing principle depicted diagrammatically in FIG. 10 is illustrated in schematic, but more structural, form in FIGS. 13 and 14. The following discussions of FIGS. 13–18 will be made with reference to the FIGS. 5–9 tube shown and described above. As explained, in the photoscreening of the screen pattern 28 on faceplate 10, it is desired to reference the screen pattern 28 (and associated color selection electrode 26) to the studs 22–25. This is accomplished as follows. The studs 22–25 are embedded in (or cemented on) the faceplate 10 with high accuracy relative to each other and with general relation to three external points which establish the center of a bogey panel.

The phosphor pattern 28 is photoscreened on the inner surface of the faceplate with reference to the studs 22–25 by the use of an exposure table, which may be of the construction shown schematically in FIG. 13 as 53. The exposure table 53 includes posts 54, 55 and 56. The posts have notches 57, 58 and 59 with side surfaces which act as three pairs of reference surfaces corresponding respectively to the pairs of reference surfaces 16*a*, 16*b*, 17*a*, 17*b*, 18*a* and 18*b* defined by funnel notches 11, 13 and 15. The faceplate 10 is supported by supports 60, 61 and 62. During the photoscreening operation, the studs 22, 23 and 25 engage the sides of the notches 57, 58 and 59 such that the phosphor pattern 28 produced is referenced to the studs 22–25.

The exposure table 53 may be substantially conventional, including an exposure chamber 64 and a point source of UV (ultra-violet) light. The point light source is illustrated as comprising a mercury lamp 66 irradiating a collimator 68 which concentrates the received light into a small effective point source at its tip 70.

The funnel referencing principles will now be described. As explained, during sealing of the neck to the funnel, the neck center line and the funnel reference surfaces are both referenced to a common reference and are thus referenced to each other. In the practice of this invention, rather than referencing the neck center line to pads ground externally on the funnel periphery as in the conventional practice (see FIG. 2), the neck center line is referenced to the internal funnel reference surfaces, such as surfaces 16a–18b (see FIG. 5).

Figures 15, 16:
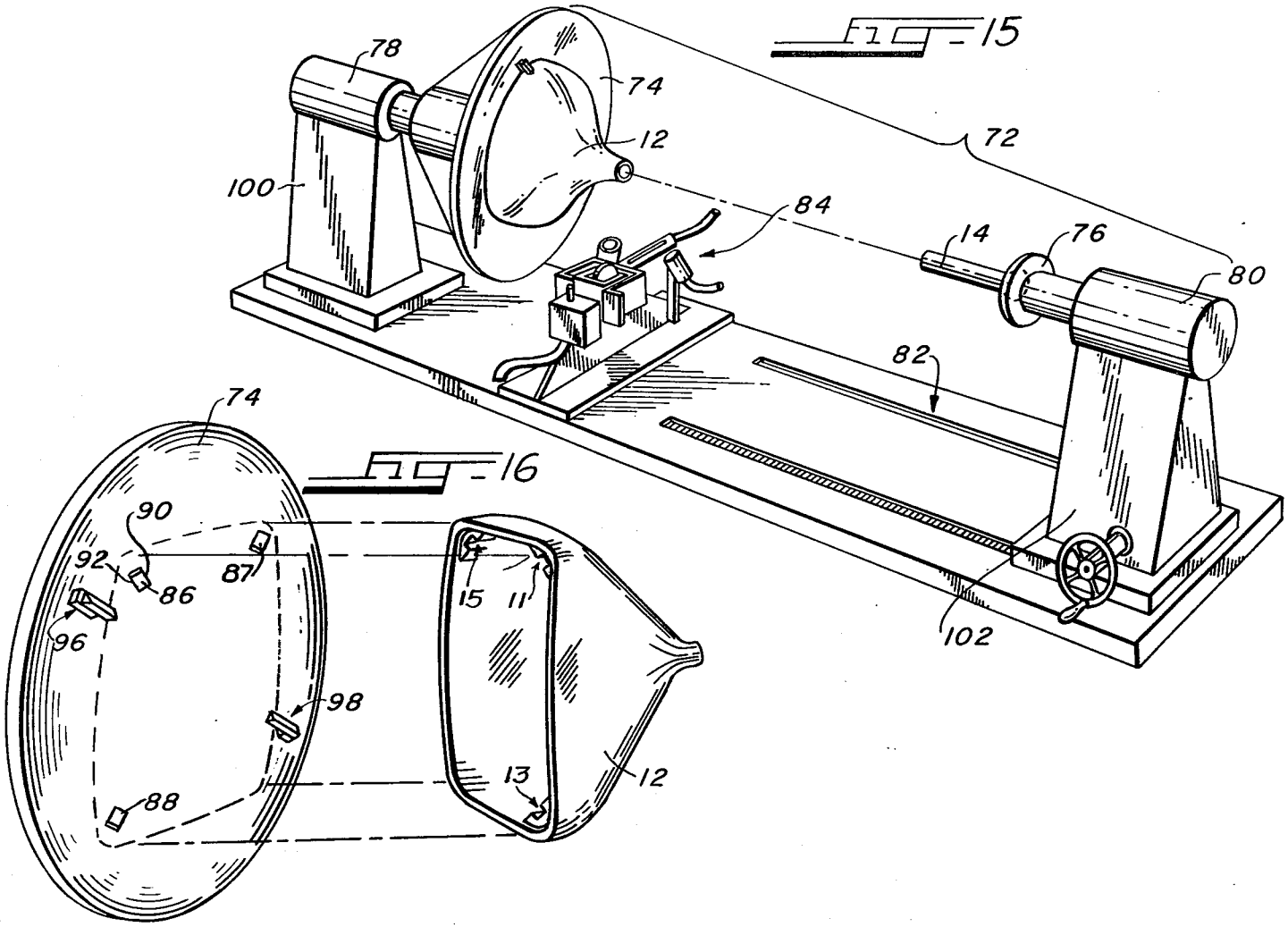
FIG. 15 is a somewhat schematic perspective view of a neck seal lathe for sealing a cathode ray tube neck and funnel according to the said referencing method.
FIG. 16 is an enlarged view of a funnel support head comprising part of the FIG. 5 lathe with the funnel exploded from the head to show hidden referencing structures on the faceplate of the head and on the inside of the funnel.

Referring to FIGS. 15 and 16, referencing of the neck center line to the funnel reference surfaces 16a–18b may be accomplished by means of a neck seal lathe 72. The lathe 72 is shown as comprising a funnel support head 74 and a neck chuck 76 which are rotated in a common direction at a common speed by motors 78 and 80. The neck chuck 76 is moved linearly along a track assembly 82 to bring the neck 14 into engagement with the funnel 12. A burner assembly 84 produces a flame which is played upon the funnel-neck joint as the funnel and neck are rotated together in coaxial mating engagement to effect a glass-to-glass seal of the neck to the funnel.

In order to reference the funnel reference surfaces 16a–18b and the neck center line to a common reference, the funnel 12 is positioned on the funnel support head 74 in referencing engagement with bosses 86, 87 and 88 which simulate the studs 22, 23 and 25. The bosses 86, 88 have edges defining three pairs of reference surfaces which correspond to the pairs of faceplate reference surfaces defined by the studs 22, 23 and 25. For example, the pair of reference surfaces 90, 92 on boss 86 simulate the reference surfaces 32, 30 on stud 22. See especially FIG. 16.

A pair of pivoted clamping levers 96, 98 are employed to hold the funnel 12 and to maintain it in referencing engagement with the bosses 86, 87 and 88. The clamping levers may be controllable by pneumatic pistons (not shown).

The funnel support head 74 and the neck chuck 76 are positioned and maintained in exact coaxial alignment by associated support structures 100, 102 and the track assembly 82. The reference surfaces 16a–18b and the neck center line are thus referenced to each other.

Figure 17:
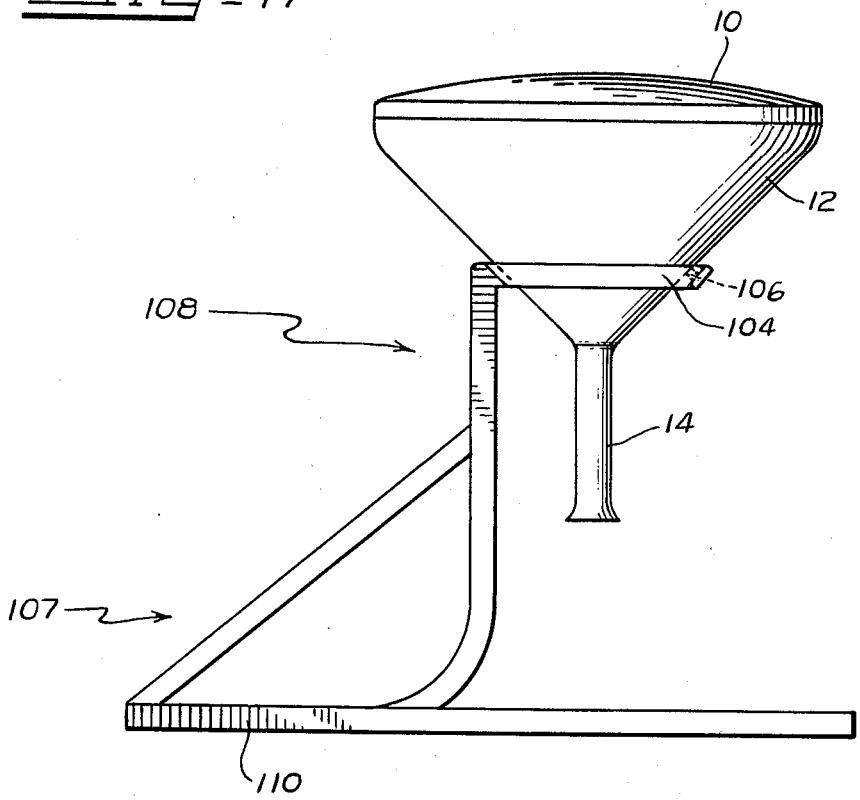
FIGS. 17 and 18 illustrate a simplified frit sealing fixture made possible by application of the principles of the present invention.

As explained, by sealing the faceplate 10 and funnel 12 with the studs 22, 23 and 25 in the notches 11, 13 and 15 and in referencing engagement with the reference surfaces 16a–18b, the screen pattern 28 (and associated color selection electrode 26) and the center line of the neck 14 are referenced to each other. The sealing operation, per se, may be conventional in the duration and temperature of the bake cycle, the oven employed, and other such details. As noted, however, the described method permits the use of an economical sealing fixture 103, such as shown in FIGS. 17–18 (described hereinafter).

To seal the faceplate 10 and funnel 12, the color selection electrode 26 is attached to the faceplate 10. A quantity of frit-type solder glass is placed on the seal land at the mouth of the funnel 12, and the funnel 12 is placed in the fixture 103. The faceplate-funnel assembly is placed in an oven suitable for the frit-sealing operation. FIG. 17 depicts an assembled tube as it would appear during the frit seal baking operation. Because the faceplate 10 is fully captured by the funnel 12 against beyond-tolerance translational and rotational relative movement, the fixture 103 may orient the tube vertically upright, as shown, during the frit-sealing operation. In prior art methods, because the faceplate was not captured by the funnel, the tube was tilted during the frit-sealing operation so that gravitational forces held the faceplate and funnel in referencing engagement. To have the tube in a vertical attitude has advantages in certain tube processing operations.

Figure 18:
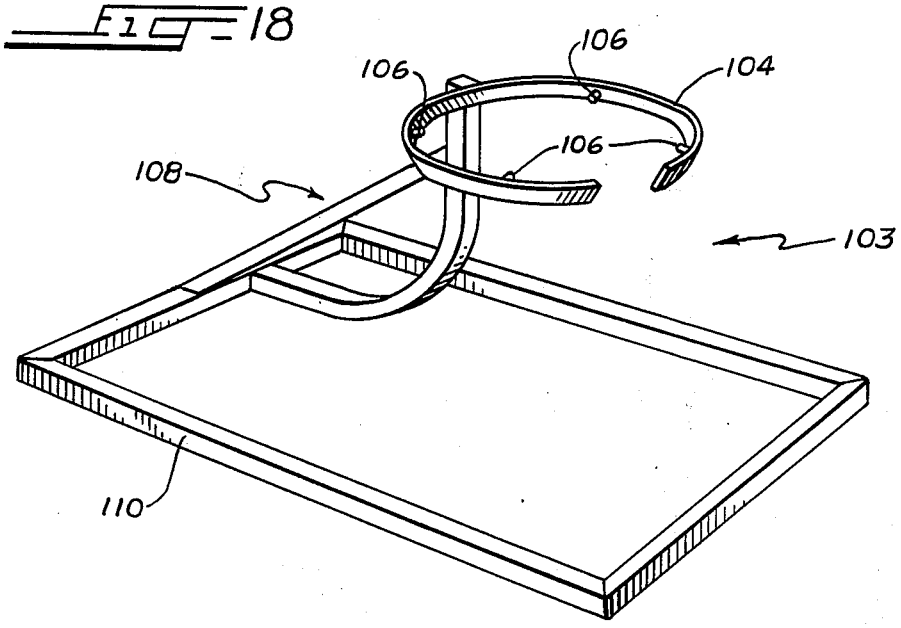

It can be seen in FIG. 18 that the frit sealing fixture 103 may comprise simply a C-ring 104 having four carbon buttons 106 for engaging the funnel; the C-ring 104 is supported by an arm assembly 108 attached to a base 110. Since referencing is accomplished within the tube envelope in accordance with this invention, the external referencing buttons provided in prior art fixtures, such as shown in U.S. Pat. No. 3,737,065, are unnecessary. The resultant fixture has reduced initial cost and greatly reduced maintenance expense.

Figure 19:
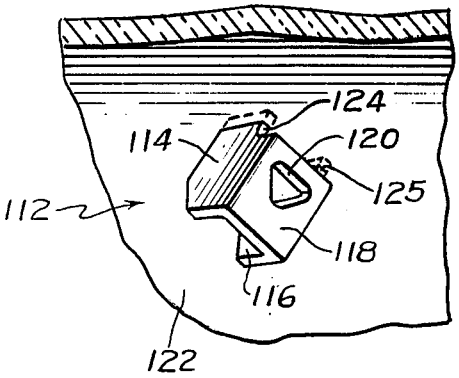
FIG. 19 illustrates an alternative form of a stud which may be employed in the implementation of the principles of this invention.

The invention is not limited to the particular details of construction of the embodiments depicted and other modifications and applications are contemplated. In other embodiments of the invention, the configuration of the studs may be modified to facilitate engagement with mating notches. For example, FIG. 19 illustrates an alternative form of a stud useful in executing the present invention. The FIG. 19 stud 112 does not constitute a part of this invention, per se, but is described and claimed in copending application Ser. No. 527,001.

The FIG. 19 stud 112 has certain advantages when used with a system of notches as shown in the preferred FIGS. 5–9 embodiment. The FIGS. 5–9 mask suspension system tends to interfere with the notches if a stud having the form of the stud 22 (see FIG. 6) is employed. The FIG. 19 stud 112 obviates this difficulty, having a channel-shape which provides a pair of arms 114, 116 which extend radially from a central stud section 118 containing an aperture 120 for receiving a mask-suspension lug such as 37 in FIGS. 8–9. The arms 114, 116 reach radially outwardly and engage the notch, freeing the central section 118 to engage the mask suspension system without interference by the notch.

In order to prevent collection in the stud 112 of fluid materials which are deposited on the faceplate 122 during screening of the faceplate, the lower part of the central section 118 of the stud 112 is preferably cut away such that the stud effectively stands on legs 124, 125; the central section 118 is thus cantilevered. This expedient also acts to reduce splashback of the fluids from the stud onto the screen area of the faceplate and thereby promotes more uniform fluid coating in the areas of the studs.

Figure 20:
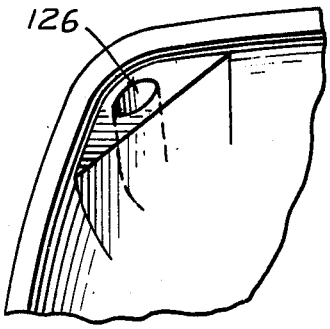
FIG. 20 depicts yet another funnel referencing structure which may be employed to carry out this invention.

As suggested above, the reference surfaces may be provided by means other than integral formations in the funnel. The recesses illustrated in the FIGS. 5–9 embodiment are shown as being of generally rectangular cross-section. The principles of this invention may be employed with notches of other configurations, with either an open or closed side facing the tube axis. For example, FIG. 20 illustrates an alternative funnel referencing means which is not literally a notch but could more appropriately be described as a deep recess 126. The recess 126 is shown as being of generally circular or elliptical cross-section, however, it may have any of a number of shapes consistent with providing a pair of reference surfaces which engage referencing means extending from the mating tube component. The FIG. 20 arrangement is most suitably used with a stud of the type shown at 22 in the FIGS. 5–9 embodiment, rather than a stud of the channel-type shown in FIG. 19.

Whereas each of the afore-described embodiments employ three pairs of funnel reference surfaces which are engaged by three pairs of faceplate reference surfaces, it should be understood that the principles of this invention are not limited to this number, arrangement or configuration of reference surfaces. The pairs of reference surfaces need not be located on the corners of the faceplate-funnel assembly, but are preferably located there in order that the faceplate referencing means may be a multi-purpose stud which also serves to support a color selection electrode for the tube. Whereas the faceplate reference surfaces are described as being defined by electrode-supporting studs, alternatively, they may be formed as elements having no other function that referencing. These elements may be formed integrally with the faceplate, or may be ancillary embedded-in or cemented-on structures.

Still other changes may be made in the above-described methods and apparatus without departing from the true spirit and scope of the invention herein involved and it is intended that the subject matter in the above depiction shall be interpreted as illustrative and not in a limiting sense.

I claim:

1. In a rectangular-type color cathod ray tube of a type having a color selection electrode, the combination comprising:

an approximately rectangular, flangeless faceplate having a concave inner surface for receiving a phosphor screen and having referencing means in at least three corners thereof extending from said inner surface of said faceplate to define in each of said three corners two tangentially spaced faceplate reference surface areas; and a funnel having an approximately rectangular mouth adapted to be sealed to said faceplate and provided in each of at least three corners corresponding to said three corners of said faceplate a notch molded integrally into said funnel and having an open side addressing the funnel axis, said notch having sides adjoining said open side which define a pair of tangentially spaced inside funnel reference surfaces oriented to capture therebetween the associated faceplate reference surface areas when the faceplate and funnel are assembled, said funnel reference surfaces collectively making interlocking referencing engagement with said associated faceplate reference surface areas to uniquely determine the location of said faceplate relative to said funnel and prevent beyond-tolerance rotational and translational relative movement therebetween.

2. The apparatus defined by claim 1 wherein said referencing means comprise studs including means for holding the color selection electrode for the tube.

3. The apparatus defined by claim 2 wherein said studs and said notches each have a substantially rectangular cross-section, the width of each notch being slightly greater than the width of the received stud such that said pair of reference surfaces defined by the notch closely embraces the sides of the stud, said sides of the stud constituting said faceplate reference surface areas.

4. The apparatus defined by claim 3 wherein said notches are each oriented toward the faceplate center.

5. In a rectangular-type color cathode ray tube, the combination comprising:

an approximately rectangular, flangeless faceplate having studs secured in the four corners thereof which extend from a common inner surface of said faceplate, at least three of which studs define a pair of spaced faceplate reference surfaces;

a funnel having an approximately rectangular mouth adapted to be sealed to said faceplate and provided in each of three corners in registry with said three of said studs a notch molded integrally into said funnel and having an open side addressing the funnel axis, said notch having sides adjoining said open side which define a pair of inside funnel reference surfaces, said pairs of faceplate reference surfaces being oriented, located and spaced so as to be respectively captured by and to make referencing engagement with said pairs of funnel reference surfaces when the faceplate and funnel are assembled, said faceplate and funnel reference surfaces uniquely determining the location of said faceplate relative to said funnel and preventing beyond-tolerance translational and rotational relative movement therebetween; and a color selection electrode and mounting means on said electrode for retentively engaging said studs such that said electrode is supported adjacent said faceplate inner surface.

6. The apparatus defined by claim 5 wherein said studs and said notches each have a substantially rectangular cross-section, the width of each notch being slightly greater than the width of the received stud such that said pair of funnel reference surfaces defined by the notch closely embraces the sides of the stud, said sides of the stud constituting said pair of faceplate reference surfaces.

* * * * *